United States Patent [19]

Medlin et al.

[11] 4,417,621

[45] Nov. 29, 1983

[54] METHOD FOR RECOVERY OF OIL BY MEANS OF A GAS DRIVE COMBINED WITH LOW AMPLITUDE SEISMIC EXCITATION

[76] Inventors: William L. Medlin; Lucien Masse'; Gary L. Zumwalt, all of Dallas, Tex.

[21] Appl. No.: 315,781

[22] Filed: Oct. 28, 1981

[51] Int. Cl.[3] ..... E21B 43/16

[52] U.S. Cl. ..... 166/249; 166/268

[58] Field of Search ..... 166/177, 249, 268

[56] References Cited

U.S. PATENT DOCUMENTS

| | | | |
|---|---|---|---|
| 2,670,801 | 3/1954 | Sherborne | 166/249 |
| 2,700,422 | 1/1955 | Bodine, Jr. | 166/249 |
| 3,527,300 | 9/1970 | Phillips | 166/249 |
| 3,754,598 | 8/1973 | Holloway, Jr. | 166/249 |
| 3,952,800 | 4/1976 | Bodine | 166/249 |
| 4,022,275 | 5/1977 | Brandon | 166/249 |
| 4,049,053 | 9/1977 | Fisher et al. | 166/249 |
| 4,280,558 | 7/1981 | Bodine | 166/249 X |

*Attorney, Agent, or Firm*—Alexander J. McKillop; James T. Powers, Jr.; Laurence O. Miller

*Primary Examiner*—George A. Suchfield

[57] ABSTRACT

The present invention relates to a method for recovering oil from a subterranean, viscous oil-containing formation by injecting a gaseous driving fluid such as carbon dioxide into the formation and recovering oil therefrom while simultaneously transmitting vibrations in the seismic frequency range having an amplitude not exceeding 100 Angstrom units through the formation which enhances the flow of the carbon dioxide and thereby increases the efficiency of recovering the oil. The frequency of the vibrations is within the range of 0.1 the 500 Hz and preferably 1 to 100 Hz.

11 Claims, 2 Drawing Figures

GAS FLOW THROUGH OIL SATURATED HEALDTON SAND $S_o$ = 0.8

CONFINING PRESSURE = 500 PSI

DIFFERENTIAL PRESSURE = 350 PSI

FREQUENCY = 100 Hz

AMPLITUDE = 100° A

METHOD FOR RECOVERY OF OIL BY MEANS OF A GAS DRIVE COMBINED WITH LOW AMPLITUDE SEISMIC EXCITATION

BACKGROUND OF THE INVENTION

The present invention relates to the use of low amplitude vibrations in the seismic frequency range for enhancing the recovery of oil from subterranean, viscous oil-containing formations employing a gaseous driving fluid such as carbon dioxide to drive the oil from the formation.

Sonic energy has been used for increasing the recovery of oil from an oil-bearing formation employing fluid drive, such as water flooding, gas drive, and the like, as shown in the patent to Sherborne, U.S. Pat. No. 2,670,801. The Sherborne process discloses the use of sonic or supersonic vibrations impressed upon an oil-bearing formation prior to and/or during a liquid flooding or gas driving recovery process to enhance the efficiency.

The patent to Bodine, U.S. Pat. No. 2,700,422, discloses the use of sonic vibrations in the frequency range of 10 to 30 cps for enhancing the recovery of oil from oil-containing formations in conjunction with a liquid driving fluid for sweeping oil from the formation.

The patent to Holloway, Jr., U.S. Pat. No. 3,754,598, discloses an enhanced flooding fluid process for the secondary recovery of oil from oil-containing formations wherein during the recovery operation oscillating pressure waves are transmitted from the injection well through the formation having a preselected amplitude in the range of about 10 to 5,000 psi above the formation pressure and a frequency in the range of about 0.001 to about 25 cycles per second.

In addition, other patents of interest are U.S. Pat. No. 3,189,536 to Bodine; U.S. Pat. No. 3,520,362 to Galle; U.S. Pat. No. 3,527,300 to Phillips; U.S. Pat. No. 3,952,800 to Bodine; and U.S. Pat. No. 4,060,128 to Wallace.

SUMMARY OF THE INVENTION

The present invention involves a method for the recovery of viscous oil from a subterranean oil-bearing formation by injecting a gas, preferably carbon dioxide, into the formation via an injection well to drive the oil through the formation and recover the oil therefrom via a spaced apart production well wherein the oil-containing formation is subjected to vibrations in the seismic frequency range having an amplitude not exceeding 100 Angstrom units during the carbon dioxide driving operation to enhance its efficiency. The frequency of the vibrations is within the range of 0.1 to 500 Hz and preferably 1 to 100 Hz. The seismic frequency excitation of the formation is produced by generating seismic energy by means of a seismic source driven by air, gas, electric, or steam power coupled to the earth's surface or the fluid medium in one of the wellbores. The low amplitude seismic frequency excitation enhances the flow of carbon dioxide through the oil-containing formation and therefore increases the efficiency of oil recovery therefrom.

DESCRIPTION OF THE PREFERRED EMBODIMENTS

Figure 1:
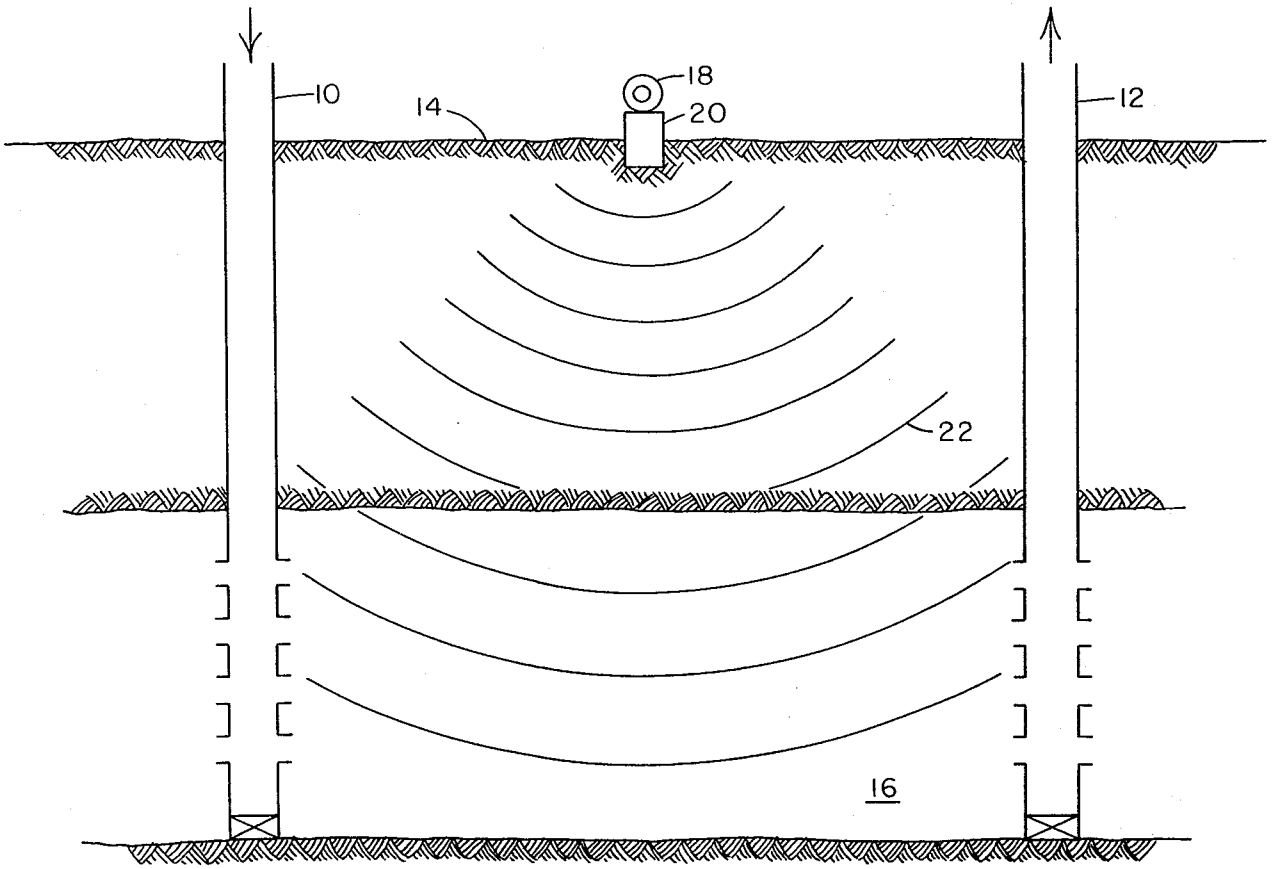
FIG. 1 shows the oil-containing formation, injection well, and seismic energy source coupled to the earth's surface and the production well.

Referring to FIG. 1, an injection well 10 and a production well 12 extend from the earth's surface 14 through a subterranean, viscous oil-containing formation 16. Both the injection well 10 and the production well 12 are provided with perforations or other fluid communication means to establish fluid communication with the full vertical thickness of the formation 16. A suitable seismic energy source 18 such as a vibrator or transducer driven by suitable power such as air, electrical, or steam power (not shown) is coupled to the earth's surface 14 by means of pier 20.

With the seismic energy source 18 in position, power is supplied to the source and seismic energy is generated which coupled to the earth's surface through pier 20 produces seismic vibrations 22 having an amplitude not exceeding 100 Angstrom units (Å) that excite the oil-containing formation 16. The frequency of the vibrations is within the range of 0.1 to 500 Hz and preferably 1 to 100 Hz.

During excitation of the formation 16 by the low amplitude seismic vibrations 22, a gaseous driving fluid, preferably carbon dioxide, is injected into the formation via injection well 10 so as to drive the oil through the formation and recover the oil from the formation via production well 12. Injection of the carbon dioxide and generation of the seismic energy coupled to the earth's surface is continued until there is a breakthrough of carbon dioxide at production well 12. Once carbon dioxide is being produced in well 12, production of the oil and generation of the seismic energy is terminated. Although the preferred gaseous driving fluid is carbon dioxide, other gases may be used such as air, nitrogen, natural gas, and mixtures thereof.

The low amplitude seismic energy excitation of the oil-containing formation enhances the flow of carbon dioxide through the formation thereby increasing the recovery of oil therefrom.

It should be understood that excitation of the oil-containing formation can be accomplished by coupling the seismic energy source to the fluid medium contained within the injection well or production well. It should also be understood that the well through which the seismic energy is coupled can be either cased or open hole and the seismic energy source can be located either at the surface or downhole positioned at different locations relative to the depth of the oil-containing formation to be excited.

EXPERIMENT

Figure 2:
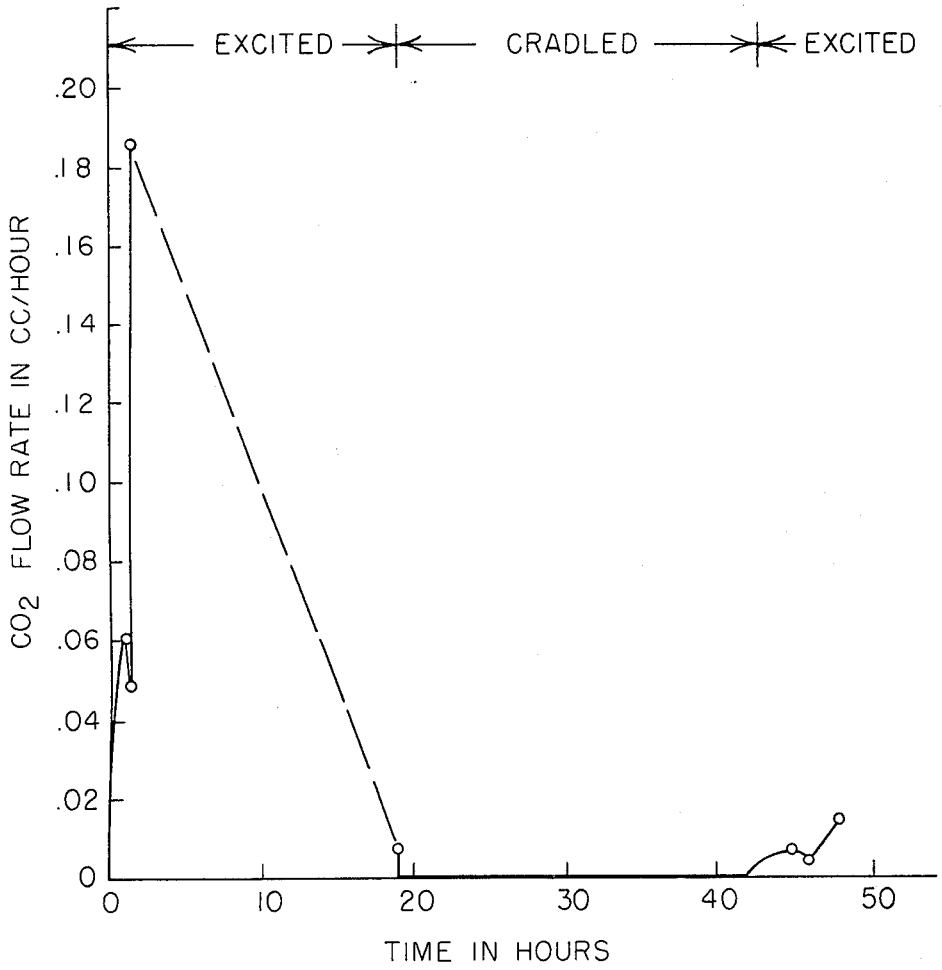
FIG. 2 illustrates the rate of flow of $CO_2$ through an oil-saturated core sample versus time for tests conducted under seismic frequency excitation and under a clamped or cradled state.

An oil-saturated core sandstone sample drilled from a reservoir in the Healdton Area Field in Oklahoma was mounted in an oscillator apparatus. The sample was vibrated at an amplitude of 100Å. and a frequency of 100 Hz. During vibration, carbon dioxide was injected into the core sample under a confining pressure of 500 psi and flow was produced by a differential pressure of 350 psi across the ends of the sample. FIG. 2 shows the influence of low amplitude seismic frequency vibration in this apparatus on carbon dioxide flow through the sample with an oil saturation ($S_o$) equal to 0.8. The results show that seismic vibration enhances carbon dioxide flow through the oil-saturated sample which was as high as 0.18 cc/hr. during a 19 hour test period. However, when the sample was clamped and unexcited, there was no flow during the next 24 hours. When excitation was resumed, carbon dioxide flow commenced again at a rate comparable with that of the initial cycle.

The results of the above experiment illustrate that carbon dioxide miscible flooding of oil reservoirs can be enhanced by low amplitude seismic excitation of the reservoir.

While the invention has been described in terms of a single injection well and a single spaced-apart production well, the method according to the invention may be practical using a variety of well patterns. Any other number of wells, which may be arranged according to any pattern, may be applied in using the present method as illustrated in U.S. Pat. No. 3,927,716 to Burdyn et al.

What is claimed is:

1. A method for recovering oil from a subterranean, viscous oil-containing formation penetrated by at least one injection well and at least one spaced-apart production well, both of said injection and production wells being in fluid communication with a substantial portion of the formation, comprising:

(a) generating seismic energy and coupling said seismic energy to the earth's surface so as to produce seismic vibrations having a frequency in the seismic range of 0.1 to 500 Hz and an amplitude not exceeding 100 Angstrom units that are transmitted through the oil-containing formation;

(b) simultaneously injecting a gaseous driving fluid into the formation via said injection well whereby said seismic vibration enhance the flow of said gas through the formation toward the production well; and (c) recovering fluids including oil from the formation via the production well.

2. A method as recited in claim 1 wherein the frequency of the vibrations transmitted through the formation is 1 to 100 Hz.

3. A method as recited in claim 1 wherein production of fluids from the formation is continued until gaseous fluid production occurs at the production well.

4. The method recited in claim 1 wherein said gaseous driving fluid comprises a gas selected from the group consisting of air, nitrogen, carbon dioxide, natural gas, and mixtures thereof.

5. The method recited in claim 1, wherein said gaseous driving fluid comprises carbon dioxide.

6. A method for recovering oil from a subterranean, viscous oil-containing formation penetrated by at least one injection well and at least one spaced-apart production well, both of said injection and production wells being in fluid communication with a substantial portion of the formation, comprising:

(a) generating seismic energy and coupling said seismic energy to the fluid in the injection well at the head of said well so as to produce seismic vibrations having a frequency in the seismic range of 0.1 to 500 Hz and an amplitude not exceeding 100 Angstrom units that are transmitted through the oil-containing formation;

(b) simultaneously injecting a gaseous driving fluid into the formation via said injection well whereby said seismic vibrations enhance the flow of said gas through the formation toward the production well; and (c) recovering fluids including oil from the formation via the production well.

7. A method as recited in claim 6 wherein the frequency of the vibrations transmitted through the formation is 1 to 100 Hz.

8. A method as recited in claim 6 wherein the generated seismic energy is coupled to the fluid in the injection well at a location within the thickness of the oil-containing formation.

9. A method for recovering oil from a subterranean, viscous oil-containing formation penetrated by at least one injection well and at least one spaced-apart production well, both of said injection and production wells being in fluid communication with a substantial portion of the formation, comprising:

(a) generating seismic energy and coupling said seismic energy to the fluid in the production well at the head of the well so as to produce seismic vibrations having a frequency in the seismic range of 0.1 to 500 Hz and an amplitude not exceeding 100 Angstrom units that are transmitted through the oil-containing formation;

(b) simultaneously injecting a gaseous driving fluid into the formation via said injection well whereby said seismic vibrations enhance the flow of said gas through the formation toward the production well; and (c) recovering fluids including oil from the formation via the production well.

10. A method as recited in claim 9 wherein the frequency of the vibrations transmitted through the formation is 1 to 100 Hz.

11. A method as recited in claim 9 wherein the generated seismic energy is coupled to the fluid in the production well at a location within the thickness of the oil-containing formation.

* * * * *